US008239060B2

(12) United States Patent
Tokushige

(10) Patent No.: US 8,239,060 B2
(45) Date of Patent: Aug. 7, 2012

(54) SHEET PROCESSING SYSTEM AND CHECKING METHOD OF THE SAME

(75) Inventor: Takuji Tokushige, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 493 days.

(21) Appl. No.: 12/502,586

(22) Filed: Jul. 14, 2009

(65) Prior Publication Data

US 2010/0082150 A1 Apr. 1, 2010

(30) Foreign Application Priority Data

Sep. 29, 2008 (JP) ..... 2008-250843

(51) Int. Cl.
*G06F 7/00* (2006.01)
*G06K 7/00* (2006.01)
*B07C 5/00* (2006.01)

(52) U.S. Cl. ..... 700/224; 700/221; 700/223; 700/227; 700/219; 235/486; 209/534

(58) Field of Classification Search ..... None
See application file for complete search history.

(56) References Cited

U.S. PATENT DOCUMENTS

2006/0081509 A1 4/2006 Otsuka
2007/0176005 A1 1/2007 Kahl

FOREIGN PATENT DOCUMENTS

EP 1 195 725 4/2002
EP 1 643 460 4/2006
EP 1 975 887 10/2008
JP 2006-99391 A 4/2006
JP 2007-200149 A 8/2007
WO WO 2008/129293 10/2008

OTHER PUBLICATIONS

European Search Report dated Sep. 29, 2010.

*Primary Examiner* — Gene Crawford
*Assistant Examiner* — Yolanda Jones
(74) *Attorney, Agent, or Firm* — Pillsbury Winthrop Shaw Pittman, LLP

(57) ABSTRACT

A sheet processing system includes an arrangement device, a sheet processing apparatus, and a server with a communication line to count and sort sheets. The arrangement device includes an input unit configured to input attribute information of the sheets, a reading apparatus configured to, sort the sheets to a first sheet group and a second sheet group by respective first and second identification cards, and a unified identification card corresponding to a unified sheet group. A transmitting unit processes the input attribute information and the identification information, transmits the processed arrangement processing information to the server via the communication line. A sorter conveys and sorts the sheet groups and identification cards. A second reading apparatus reads the identification information, and a CPU checks the information from the server.

14 Claims, 7 Drawing Sheets

| TRAY CARD NO. | NUMBER OF BATCH CARDS |
|---|---|
| 1000 | 4 (2, 10, 11, 13) |
| 2000 | 3 (3, 14, 15) |
| | |

FIG. 7

| CARD NO. |
|---|
| 2 |
| 10 |
| 11 |
| 13 |
| 1000 |
| 3 |
| 14 |
| 15 |
| 2000 |
| |

FIG. 8

SHEET PROCESSING SYSTEM AND CHECKING METHOD OF THE SAME

CROSS-REFERENCE TO RELATED APPLICATION

This application is based upon and claims the benefit of priority from the prior Japanese Patent Application No. 2008-250843, filed on Sep. 29, 2008; the entire contents of all of which are incorporated herein by reference.

FIELD OF THE INVENTION

The present invention relates to a sheet processing system and a checking method thereof.

DESCRIPTION OF THE BACKGROUND

As disclosed in Japanese Patent Application Publication No. 2007-200149, the conventional sheet processing system records identification information in the handling box, relates the identification information to identification information of a batch card, thereby can prevent, for example, forgetting to count sheets of one batch or intentional pull-out of sheets of one batch.

However, it is necessary to install an apparatus for reading the identification information recoded in the handling box separately in the sheet processing system; thus the system constitution is complicated. Further, it is not easy to simplify the system constitution.

SUMMARY OF THE INVENTION

The present invention is intended to provide a sheet processing system for preventing forgetting to count sheets of one batch and intentional pull-out of sheets of one batch using a simple system constitution and a checking method thereof.

According to embodiments of the present invention, there is provided a sheet processing system including an arrangement device, a sheet processing apparatus, and a server with a communication line to count and sort sheets, the system comprising: the arrangement device including: an input unit configured to input attribute information of the sheets; a first reading apparatus configured to sort the sheets to a first sheet group and a second sheet group by a first identification card corresponding to the first sheet group and a second identification card corresponding to the second sheet group, furthermore unify the first sheet group and the second sheet group to one, form one processing unit by a unified identification card corresponding to the unified one, and read first identification information, second identification information, and unified identification information assigned respectively to the first identification card, the second identification card, and the unified identification card; and a transmitting unit configured to process the input attribute information and the first identification information, second identification information, and unified identification information read by the first reading apparatus and transmit the processed arrangement processing information to the server via the communication line, the sheet processing apparatus including: a processing apparatus configured to convey and sort the first sheet group and second sheet group, the first identification card, the second identification card, and the unified identification card prepared by the arrangement device; a second reading apparatus configured to read the first identification information, the second identification information, and the unified identification information; and a CPU configured to check the arrangement processing information obtained from the server via the communication line with the first identification information, the second identification information, and the unified identification information read by the second reading apparatus.

Further, according to embodiments of the present invention, there is provided A checking method of a sheet processing system including an arrangement device, a sheet processing apparatus, and a server with a communication line to count and sort sheets, wherein: the arrangement device: inputting attribute information of the sheets; sorting the sheets into a first sheet group and a second sheet group by a first identification card corresponding to the first sheet group and a second identification card corresponding to the second sheet group; unifying the first sheet group and the second sheet group to one; forming one processing unit by a unified identification card corresponding to the unified one; reading first identification information, second identification information, and unified identification information assigned respectively to the first identification card, the second identification card, and the unified identification car; processing the input attribute information and the first identification information, second identification information, and unified identification information read; and transmitting the processed arrangement processing information to the server via the communication line, the sheet processing apparatus: conveying and sorting the first sheet group and second sheet group, the first identification card, the second identification card, and the unified identification card arranged by the arrangement device; reading the first identification card, the second identification card, and the unified identification card; and checking the arrangement processing information obtained from the server via the communication line with the first identification information, the second identification information, and the unified identification information read by the sheet processing apparatus.

BRIEF DESCRIPTION OF THE DRAWINGS

FIG. 7 is a conceptual diagram of the information of the number of batch cards and card Nos. for the tray card obtained from the arrangement device which are stored in the system data base;

FIG. 8 is a conceptual diagram of the information of the number of batch cards and card Nos. for the tray card read by the barcode reader installed in the sheet processing apparatus.

DETAILED DESCRIPTION OF THE INVENTION

Hereinafter, the embodiment of the present invention will be explained in detail with reference to the accompanying drawings.

Figure 1:
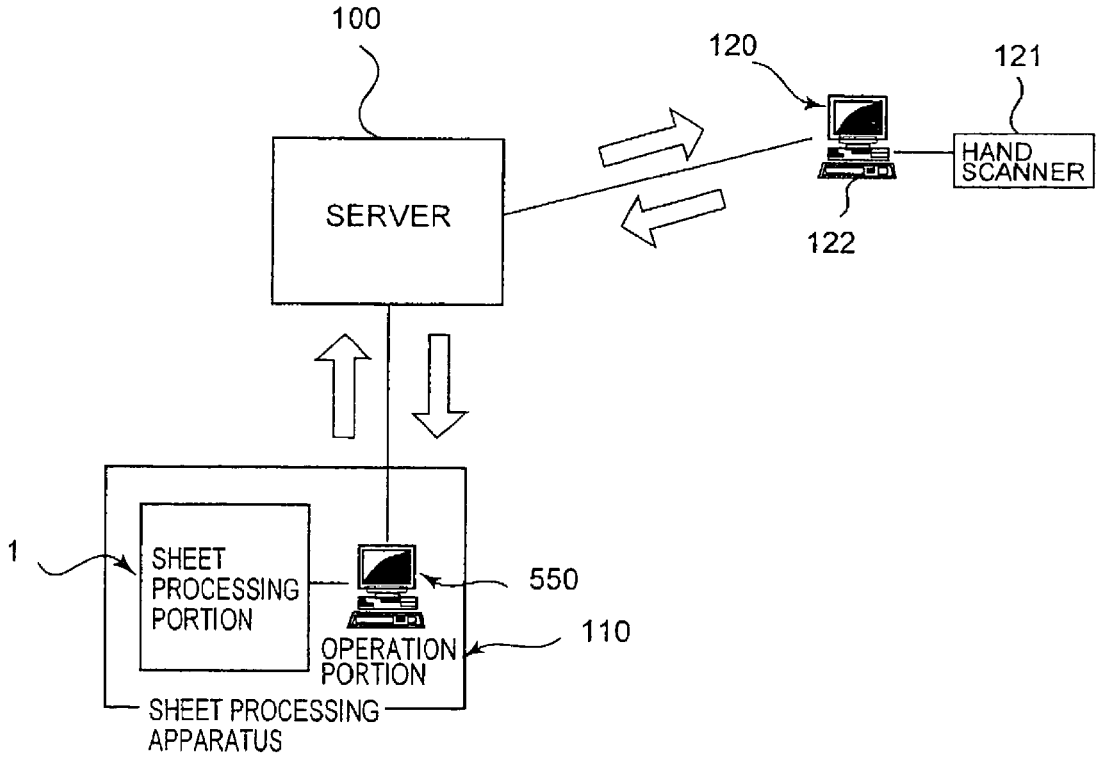
FIG. 1 is a schematic view of the sheet processing system which is an embodiment of the present invention.

FIG. 1 is a schematic view of the sheet processing system which is an embodiment of the present invention. The sheet processing system is composed of a sheet processing apparatus 110, a server 100, and an arrangement device 120.

The arrangement device 120 is a personal computer (PC) and an operator can input information to it by an accessory keyboard 122. Further, to the arrangement device 120, a hand scanner 121 is connected and batch cards and tray cards are stored by the arrangement device 120. The storage of batch cards and tray cards is to read the bar codes assigned to the batch cards and tray cards by the hand scanner 121 and process the read information and the information input to the arrangement device from the keyboard by the operator as attribute information. The attribute information is financial institution information, for example, a sum of money of sheets and an account No. The processes attribute information is transmitted to the server 100 as arrangement processing information.

The batch cards and tray cards which are stored in this way and sheets P are set in a handling box B (FIG. 4) by the operator. The sheets P in a plurality of processing units which are set in the handling box B are fed to the sheet processing apparatus 110. Further, for the batch cards and tray cards, the same cards are used and a bar code is assigned to the same place of each card.

The sheet processing apparatus 110 is composed of an operation portion 550 and a sheet processing portion 1. The sheet processing apparatus 110 is connected to the server 100 via the communication line.

The operation portion 550 obtains an instruction of service contents processed by the sheet processing portion 1, designation of dealing contents based on the designated service contents, and dealing results by the sheet processing portion 1 and transmits the dealing results to the server 100. Namely, the operation portion 550 transmits the batch card No. and tray card No. which are read by the sheet processing portion 1 and the processed count sum.

The sheet processing portion 1 is connected to the operation portion 550 and on the basis of the dealing instruction from the operation portion 550, sheets set in the handling box B are fed. The sheets are discriminated one by one by the sheet processing portion 1 and are sorted and processed on the basis of the discrimination results. When rejection bills are produced during the sheet processing, the produced rejection bills are stacked in a rejected sheets stacker 80 (FIG. 2).

Figure 2:
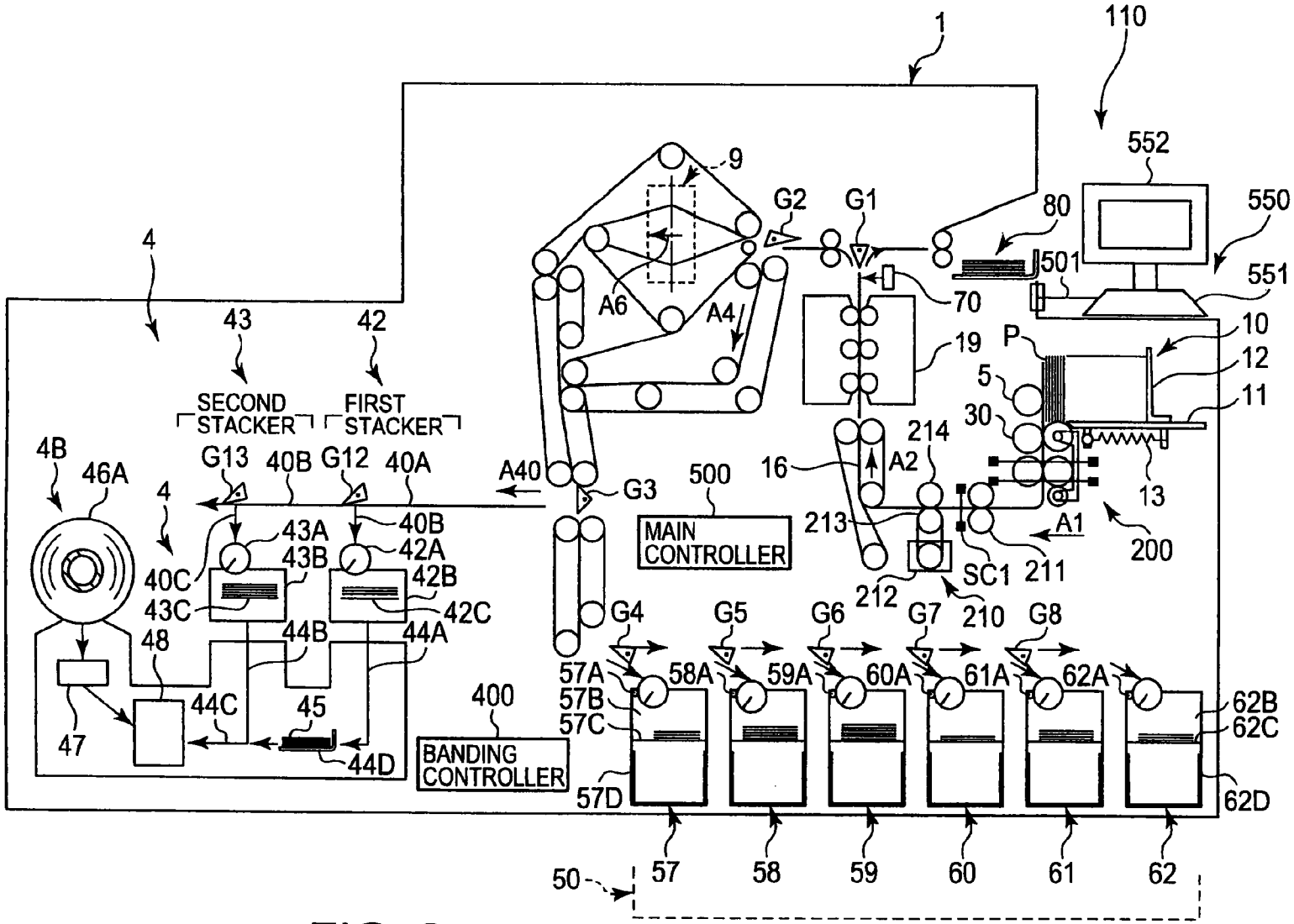
FIG. 2 is a schematic block diagram of the sheet processing apparatus.

FIG. 2 is a schematic cross sectional view of the sheet processing apparatus 110 of the embodiment of the present invention. The sheet processing apparatus 110 is composed of the sheet processing portion 1 and operation portion 550.

By an operation of an operator from the operation display 552 connected to the operation portion 550, setting of the dealing method of the paying-in service and arrangement service, cassette assignment for setting a storage (hereinafter, referred to as a cassette) for storing the processed sheets P, and setting of the qualification level of the sheets P are executed. After the setting, the sheets P of a plurality of bill kinds supplied from the handling box B to a supply portion 10 are taken out and conveyed one by one at fixed intervals and are stored or banded in cassettes (57D to 62D) which are set by the cassette assignment aforementioned. Further, at the end time of dealing of the set service, the dealing partition process accompanying each service end is performed. Furthermore, the dealing counts are summed up at each end time of the one-day service and the balance process of informing the dealing results to the server 100 is performed. To the server 100, for example, a plurality of sheet processing apparatuses 110 of this embodiment are connected and it is possible to confirm the operating condition of each of the sheet processing apparatuses 110 and sum up the processing results from each of the sheet processing apparatuses 110.

The paying-in service is a service to sort the sheets P of a plurality of bill kinds the total of money of which is known beforehand for each bill kind, each conveying direction, and each qualification using the sheet processing apparatus 110, confirm that the sum of money counted by the sheet processing apparatus 110 is correct, and store it in the server 100. Further, the sheets P processed by this service are stacked in the cassettes 57D to 62D of stacking devices 57 to 62 or are banded by a banding portion 4.

The arrangement service is a service not to store the counts in the server 100 in the paying-in service. It is not intended to count dealt bill kinds but is used to stack the bill kinds counted once in the paying-in service in the cassettes 57D to 62D of the stacking devices 57 to 62 more in detail (for example, for each surface (front or back) and each qualification (regular or defective) or to band them.

The cassettes assignment is to set the bill kinds to be stored in the cassettes 57D to 62D of the stacking devices 57 to 62 and the bill kinds to be banded by the banding portion.

The qualification level setting is to set the qualification discrimination level which is a threshold value for sorting bills to recirculatable qualified bills and disrecirculatable disqualified bills. The details will be described later, though as the qualification level is increased, the number of disqualified bills is increased.

The dealing partition process is a process, after end of each dealing, for example, when the completion button (not shown) installed in the operation display 552 is pressed, of storing sheets stacked in the stacking devices 57 to 62 in the cassettes 57D to 62D. The cassettes storing the sheets are replaced with empty cassettes by the operator.

Here, the conveying direction when the sheets P are conveyed will be explained. In the sheets P, there are four conditions available such as Face (the condition that the face is up), Back (the condition that the back is up), Forward (the print on the face or back of each sheet is upright), and Reverse (the print on the face or back of each sheet is upside-down) and there are formed four kinds of conveying directions such as face and forward FF, face and reverse FR, back and forward BF, and back and reverse BR.

The sheet processing portion 1 includes the supply portion 10 for supplying the sheets P, a sheet take-out portion 200 for taking out the sheets P supplied from the supply portion 10 one by one, and a conveying path 16 for conveying the sheets P taken out by the sheet take-out portion 200. Further, a conveyor correction portion 210 for correcting a conveying skew or a conveying displacement (conveying slide) of the sheets P conveyed by the conveying path 16 is arranged. Furthermore, a sheet discriminator 19 for discriminating the sheets P corrected in conveyance by the conveyor correction portion 210 one by one and a barcode reader 70 for reaching the barcodes of the aforementioned batch card and tray card are arranged along the conveying path 16.

The sheet discrimination results by the sheet discriminator 19 and the read results of the barcode reader 70 are transmitted to the main controller 500 for controlling the sheet processing apparatus 110. The main controller 500, on the basis of the received discrimination results, controls a conveying controller 26 and a banding controller 400 which will be described later. The conveying controller 26 controls the conveyance of sheets and controls switching gates G1, G2, - - - , and G8 and the reversing portion for reversing in order to arrange the conveying directions properly. The sheets P arranged properly in the conveying direction in this way, on the basis of the sorting method set by the operation display 552, are banded by the banding portion 4 or are stacked by a stacker 50 for stacking sheets for each bill kind.

Furthermore, the sheet processing portion 1 is connected to the operation portion 550 via an interface 503. Hereinafter, the constitution of the sheet processing portion 1 will be explained sequentially starting with the supply portion 10 of the sheets P.

The supply portion 10 is composed of a stage 11 for making contact with and aligning the sheets P including the four kinds of conveying directions mixed and a backup plate 12 installed upright in the vertical direction to the stage 11. Further, the backup plate 12 can move leftward along the stage 11 by the pressing force of a spring 13. The sheets P supplied in this way are pressed by the backup plate 12 toward a pickup roller 5. In this state, the sheets P are taken out one by one at fixed intervals due to the rotation of a take-out roller 30 and are discharged onto the conveying path 16.

The conveyor correction portion 210 is composed of a timing sensor SC1 installed in the neighborhood of conveying rollers 211 on the downstream side in the conveying direction for detecting the sheets P, conveying rollers 213 and 214, and a conveying guide not shown.

The switching gate G1 is a gate, for example, for dividing bills to rejected bills and processed bills. The rejected bill is referred to as a sheet, as a result of discrimination of the sheet P by the sheet discriminator 19, discriminated as a counterfeit bill or as an "undiscriminatable bill" which cannot be discriminated due to breaking, tearing, or skewing. Upon receipt of the discrimination results, the conveying controller rotates the switching gate G1 rightward (clockwise), thereby stacks the rejected bills in the rejected sheets stacker 80.

Further, the processed bill is referred to as a sheet when the sheet P discriminated by the sheet discriminator 19 is an authentic bill and a quality bill or an authentic bill and a disqualified bill. The conveying controller, upon receipt of the discrimination results, rotates the switching gate G1 leftward (counterclockwise), thereby sorts the concerned sheets.

The reversing portion is composed of a switch-back reversing portion (not shown) and a front/back reversing portion 9 and depending on the arranging direction; either of the switch-back reversing portion and front/back reversing portion 9 or both of them are used.

The switching gate G2 is a front/back reversion switching gate. On the basis of the discrimination results of the conveying direction of the sheet P discriminated by the sheet discriminator 19, when the front/back reversion is necessary, the conveying controller rotates the switching gate G2 rightward (clockwise), thereby permits the sheet P to pass through the front/back reversing portion 9 indicated by an arrow A6 shown in the drawing. Further, when the front/back reversion is not necessary, the conveying controller rotates the switching gate G2 leftward, thereby conveys the sheet P in the direction indicated by an arrow A4 shown in the drawing.

The front/back reversing portion 9, on the basis of the results discriminated by the sheet discriminator 19, reverses the front and back of the sheet P in the conveying direction. For example, when the conveying direction is the back and forward (BF), it is changed to the front and forward (FF) by the front/back reversing portion 9.

The switching gate G3 is a switching gate for switching the sheet P conveyed from the conveying path 16 to the banding portion 4 or the stacker 50. When the sheet P conveyed is a bill designated so as to be banded by the main controller 500, the conveying controller rotates the switching gate G3 rightward (clockwise), thereby conveys the sheet P in the direction of an arrow A40 shown in the drawing where the banding portion 4 is installed. Further, the sheets P of other bill kinds are distributed so as to be stacked in the stacking devices 57 to 62 from the switching gate G3 via the switching gates G4 to G8.

In the banding portion 4 and stacker 50, to separate the sheets P from the conveying path, at the end of the conveying path, as a stacking device for stacking the sheets P, a bladed wheel stacking device is installed.

The bladed wheel stacking device, for example, when it is the stacking device 57, is composed of a bladed wheel 57A, a temporary stacker 57B, a shutter 57C, a cassette 57D, and a pusher (not shown) for assisting the stacking.

The bladed wheel 57A is composed of a plurality of blades incorporated around the rotary shaft and so as to receive the sheets P conveyed between the blades, rotates in synchronization with the conveyance of the sheets P. By use of the bladed wheel, by absorbing the kinetic energy of the sheets P conveyed at a high speed and aligning the sheets P, the sheets P are stacked in the temporary stacker 57B.

The temporary stacker 57B used in the stacking device 57 and a temporary stacker 42 of the banding portion 4 are different in form because the objects to be processed hereafter are different from each other.

The temporary stacker 57B used in the stacking device 57 includes the shutter 57C and the sheets P are stacked on the shutter 57C. And, when the sheets P stacked in the shutter 57C, for example, become full or if the service end is instructed, the shutter 57C is opened. If the shutter 57C is opened, the stacked sheets P drop on the backup plate in the cassette 57D installed under the shutter 57C. The dropped sheets P are pressed into the cassette 57D by the pusher. Therefore, if the number of sheets pressed in increases, the backup plate moves downward. The aforementioned operations are common to the stacking devices 57 to 62.

The banding portion 4 is composed of a first stacker 42, a second stacker 43, a conveying portion, a paper strip portion 46, a paper strip supply portion 47, and a paper strip winding portion 48. In this embodiment, the case that the banding portion 4 includes the first stacker 42 and second stacker 43 will be explained, though when necessary, the two stackers are paired up, and a plurality of sets may be used.

The first stacker 42 and second stacker 43 are structured similarly, so that the constitution of the first stacker 42 will be explained and the explanation of the second stacker 43 will be omitted.

The first stacker 42 includes a switching gate G12 for switching sheets from a conveying path 40A, a conveying path 40B for conveying the distributed sheets P, a bladed wheel 42A for receiving sheets fed out from the end of the conveying path 40B, a temporary stacker 42B for stacking the sheets p received by the bladed wheel 42A, and a pusher (not shown) for pressing the stacked sheets P. Hereinafter, the constitution of each unit of the banding portion will be explained.

The temporary stacker 42B includes a backup plate 42C for counting the sheets P conveyed and sorting and stacking them for each 100 sheets.

The conveying portion is composed of vertical conveying paths 44A and 44B, a conveying carrier 44D, and a horizontal conveying path 44C. The vertical conveying paths 44A and 44B are used to move up or down 100 sheets 45 received by the backup plates 42C and 43C. Further, the conveying carrier 44D is structured so as to receive the 100 sheets 45 from the backup plate 42C or 43C at the stop position of the vertical conveying path 44A or 44B and move back and forth on the horizontal conveying path 44C to transfer them to a banding tray (not shown).

The paper strip portion 46 is composed of a paper strip 46A for banding the 100 sheets 45 stacked on the banding tray, the paper strip supply portion 47 including the printing function for printing on the paper strip 46A and the function for supplying the printed paper strip 46A, the paper strip winding portion 48 for banding the 100 sheets 45 with the printed paper strip supplied from the paper strip supply portion, and the banding controller 400 for controlling the banding portion 4.

Figure 3:
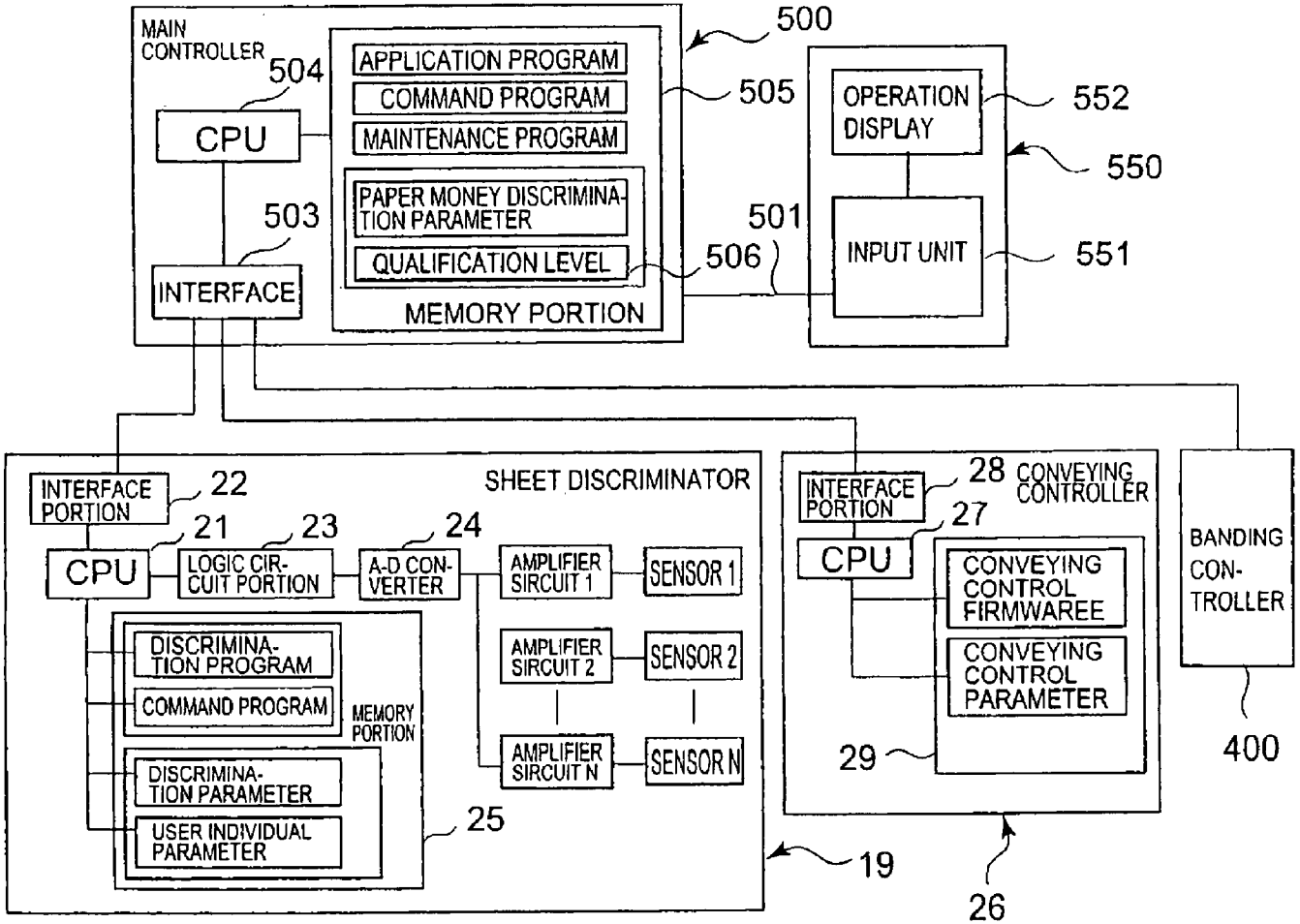
FIG. 3 is a block diagram showing the connection condition of the sheet discriminator, conveying controller, banding controller, and operation portion which are connected to the main controller.

FIG. 3 is a block diagram showing the connection condition of the sheet discriminator 19, conveying controller 26, banding controller 400, and operation portion 550 which are connected to the main controller 500.

The main controller 500, on the basis of an instruction of the operation portion 550, receives the discrimination results of the conveyed sheets P from the sheet discriminator 19 and controls the conveying controller 26 and banding controller 400 to sort the sheets P. Further, it transmits the discrimination results of the sheets P to the operation portion 550.

The sheet discriminator 19 detects the optical characteristics of the sheets P as a qualification level detector. Further, it detects the magnetic characteristics of the sheets P as an authenticity detector. A plurality of sensors 1 to n are installed to execute these detection and the sensors are composed of amplifier circuits 1 to n for amplifying output signals of the sensors 1 to n and a processing portion for processing output signals of the amplifier circuits 1 to n. The processing portion includes an A-D converter 24 for performing A-D conversions and a logic circuit portion 23 for performing logical operations for data converted from analog to digital by the A-D converter 24, and from an output signal of the logic circuit portion 23, the authenticity (authentic or counterfeit) is discriminated by the authenticity discriminator, and the qualification (quality bill or disqualified bill) is discriminated by the qualification discriminator. The processing portion is composed of a CPU 21 for controlling overall the sheet discriminator 19, a memory portion 25 accessed by the CPU 21, and an interface portion 22 for communicating the results discriminated by the CPU 21 between the main controller 500 and itself.

The conveying controller 26, by the discrimination results of the sheet discriminator 19, decides the destination of the sheets P to be conveyed and it is composed of a CPU 27 for controlling conveyance of the sheets P, a memory portion 29 accessed by the CPU 27, and an interface portion 28 with the main controller 500.

The main controller 500 includes a CPU 504 for controlling the main controller 500, a memory portion 505, and an interface portion 503 and it is connected to the sheet discriminator 19, conveying controller 26, and banding controller 400. Further, it is connected to the operation display 552 via an interface 501.

The CPU 504 transmits the information on the setting of the dealing method of the paying-in service and arrangement service which are set by an operator from the operation display 552, the setting of cassette assignment for setting a storage for storing the processed sheets P, and the setting of the qualification discrimination level which is a discrimination level of the sheets P to the sheet discriminator 19. Further, the CPU 504 receives the discrimination results of the sheets P from the sheet discriminator 19 and transmits them to the operation portion 550. Here, the dealing count when the dealing partition process is performed is transmitted.

Figure 4:
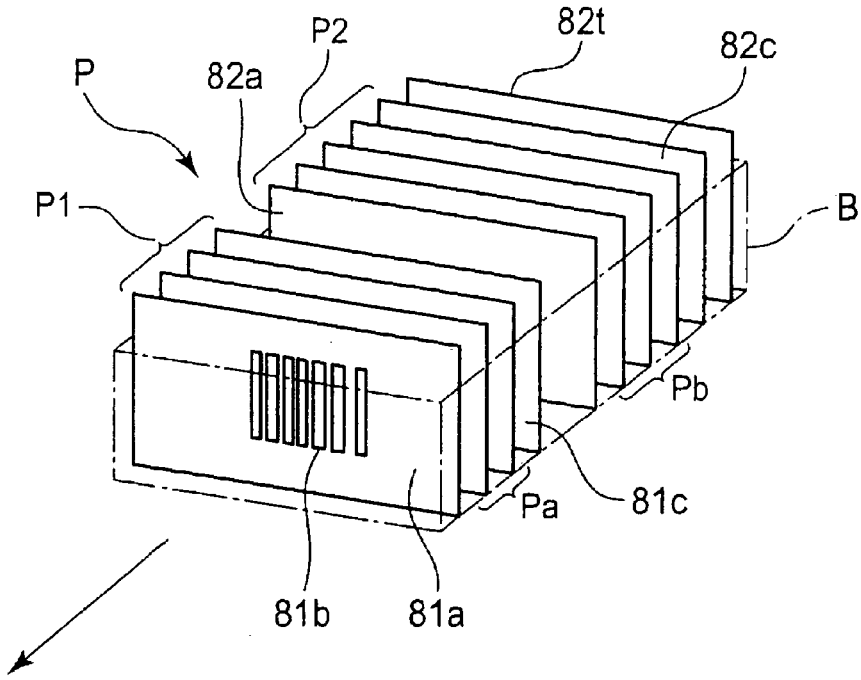
FIG. 4 is a drawing showing the condition of sheets stacked on the handling box.

FIG. 4 is a drawing showing the condition of the sheets P stacked in the handling box B. The illustrated example shows the condition that the sheets of two batches are stacked in the handling box B. As a first sheet group, the first batch P1 is sequentially composed of a batch card 81*a* as a first identification card, a sheet group Pa, and a batch card 81*c*. The batch P2 as the next second sheet group is sequentially composed of a batch card 82*a* as a second identification card, a sheet group Pb, and a batch card 82*c*. The sheets P stacked in the handling box B, so as to taken out starting from the batch card 81*a*, are moved to the supply portion 10 of the apparatus 110 from the handling box B. Further, in the handling box B, one tray card 82*t* as a unified identification card is inserted. Here, the tray card 82*t* is inserted in the handling box B so as to follow the batch card 82*c*, though if it is stacked similarly to the sheets, the sequence is no particular object. Hereinafter, the tray card 82*t* will be explained in the state that it is staked following the batch 82*c*. Further, the tray card 82*t*, when the sheets stacked in the handling box B are moved to the supply portion 10 of the sheet processing apparatus 110, is moved together to the supply portion 10.

Figure 5:
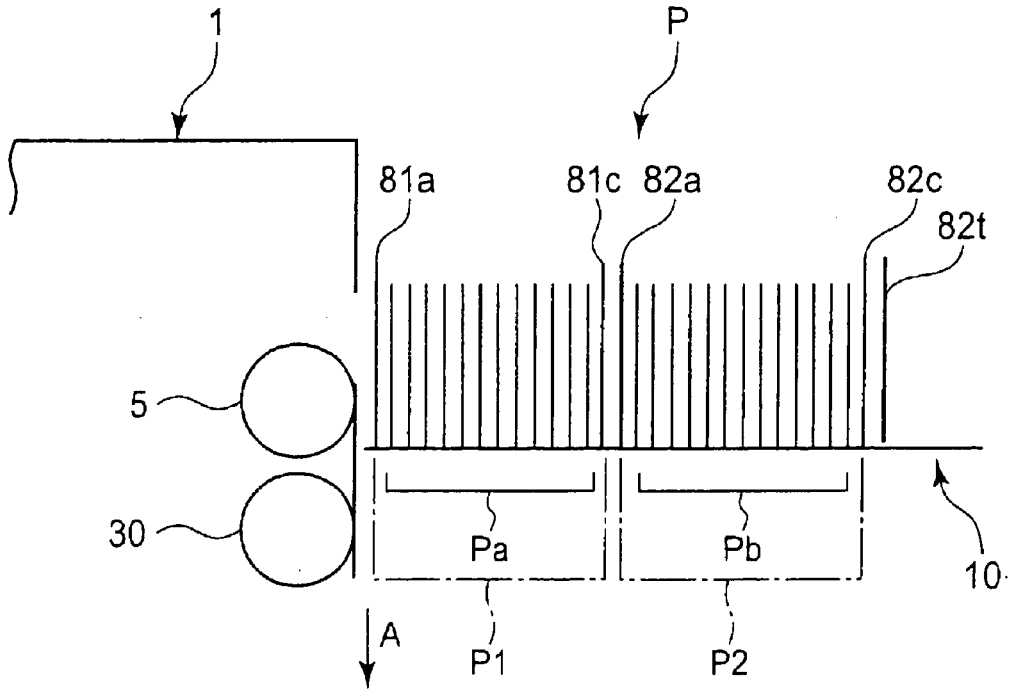
FIG. 5 is a drawing showing the condition of the sheet group shown in FIG. 4 which are fed to the sheet processing portion.

FIG. 5 shows the condition that the sheet groups P1 and P2 shown in FIG. 4 are moved from the handling box B to the supply portion 10 of the sheet processing portion 1. As shown in the drawing, the batch cards are taken out one by one starting from the batch card 81*a* of the batch P1. Further, the batch card 81*a* taken out is different from the sheets, so that a barcode 81*b* assigned to the batch card 81*a* is read by the barcode reader 70, and then it is stacked in the rejected sheets stacker 80 (will be described later in detail).

The batch card processing of the sheet processing apparatus 110 structured as mentioned above will be explained below. The batch card processing is a service method when performing sheet receiving services by a cash processing center or a bank. In this embodiment, an example that the paying-in service is performed by dividing it into the preprocess performed by the arrangement device 120 and the apparatus process performed by the sheet processing apparatus 110 will be explained.

In the preprocess, the sheet receiving phase is executed by an operator. A batch card is issued for each batch of the received sheets and the sheet to be processed is held between the issued batch card and the batch card for separating the sheets and is set in the handling box B. As mentioned previously, in the handling box B, one tray card 82*t* is inserted. By a combination of this batch card, a sheet, and the tray card, one batch is formed. In the case of small-sized batches, there exist a plurality of batches in the handling box B.

The apparatus process is a phase of sorting the sheets in the handling box B which are set by the preprocess for each batch. The sheets sorted in the phase are banded by the stacker 50 or the banding portion 4. The phase is explained already, so that it is omitted.

Figure 6:
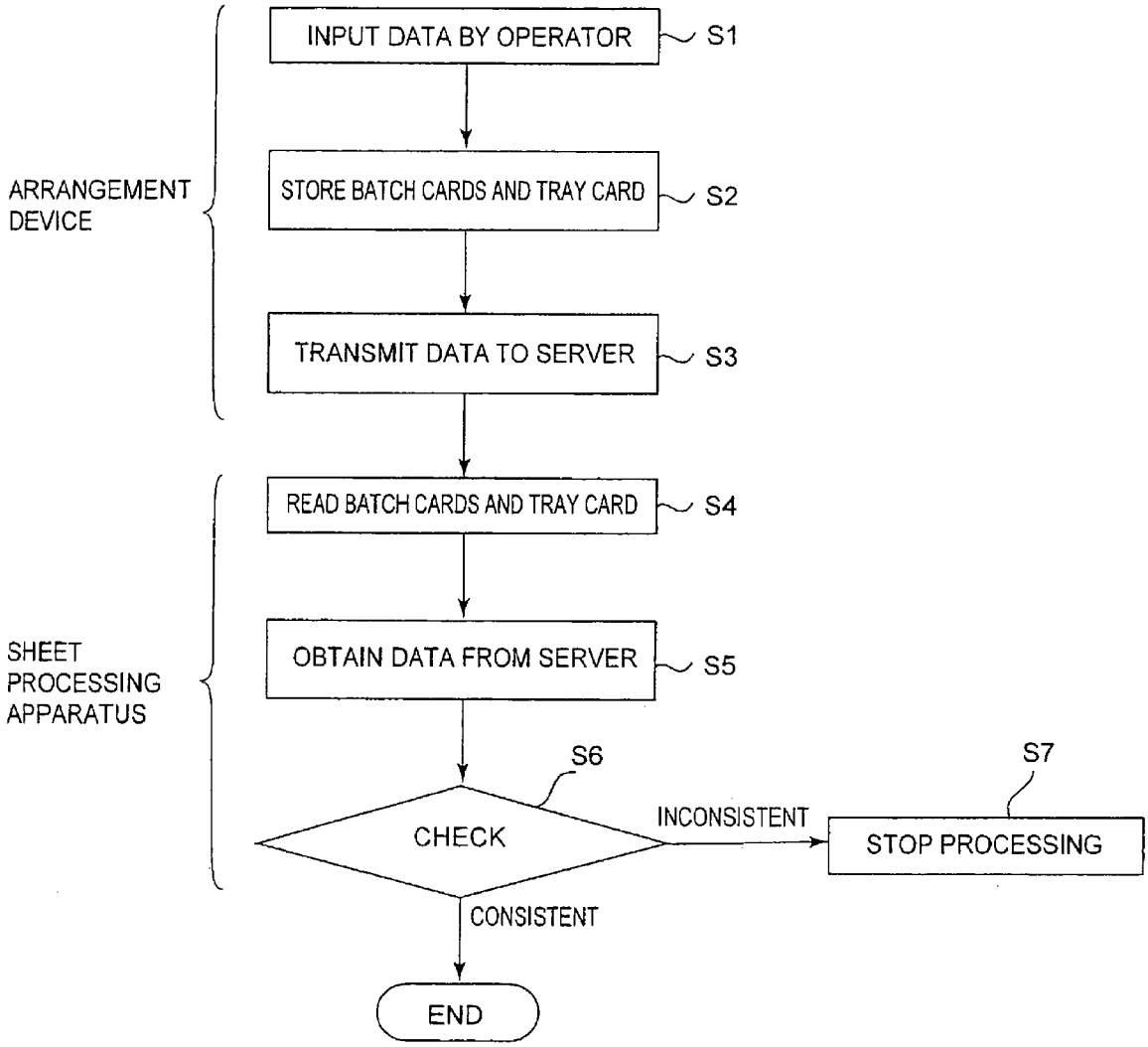
FIG. 6 is a flow chart for explaining the batch processing by the sheet processing apparatus.

FIG. 6 is a flow chart for explaining the batch card processing by the sheet processing system of the embodiment of the present invention. As mentioned previously, it is performed broadly in the two stages of the preprocess which is a phase of receiving sheets by an operator and is performed by the arrangement device and the apparatus process of sorting the sheets in the handling box B, which are set by the preprocess, for each batch by the sheet processing apparatus 110. In this case, similarly to the case of FIG. 4, the case of two batches is explained, though the number of batches is negligible.

Firstly, the preprocess performed by the arrangement device 120 will be explained. The operator inputs the account No. and the sum of money of the sheets to the arrangement device 120 using a keyboard 122 (S1).

Then, the operator, for each handling box B, reads the barcodes assigned to the batch cards 81*a* and 82*a* and the barcode assigned to the tray card 82*t* by the hand scanner 121 connected to the arrangement device 120 and stores them in the server 100 (Step S2). In the handling box B, there exists one tray card 82*t*, so that the number of batch cards for one tray card and the batch card Nos. are stored in the server 100 (Step S3). (Refer to FIG. 7.)

The batch cards 81*a* and 82*a* and tray card 82*t* in the first handling box B are stored. In the embodiment of the present invention, as a result of reading the barcode assigned to the tray card 82*t* read by the hand scanner 121, the number of the tray card 82*t* is 1000 and as a result of reading the barcodes assigned to the batch cards in the same handling box B, for example, the batch card Nos. are 2, 10, 11, and 13 and the number of batch cards is 4.

Further, similarly to the first handling box B, in the next handling box B, the batch card Nos. in the handling box B corresponding to the tray card No. 2000 are, for example, 3, 14, and 15 and the number of batch cards is 3.

FIG. 7 is a conceptual diagram of the information on the number of batch cards, tray card No. and batch card Nos. for the tray card obtained from the arrangement device 120 which are stored in the server of the embodiment of the present invention.

Then, the apparatus process performed by the sheet processing apparatus 110 will be explained. The sheets, batch cards, and tray card stored in the handling box B are moved to the supply portion 10 of the sheet processing apparatus 110. The sheets, batch cards, and tray card moved to the supply portion 10 are counted by the sheet processing portion 1. Simultaneously, the barcodes assigned to the batch cards and the barcode assigned to the tray card are read by the barcode reader 70 (Step S4). And, the read information is stored in the memory portion 505.

In the embodiment of the present invention, as a result of reading the first handling box B, the batch card Nos. in the handling box B corresponding to the tray card No. 1000 are 2, 10, 11, and 13 and the number of batch cards is 4. Further, as a result of reading the next handling box B, the batch card Nos. in the handling box B corresponding to the tray card No. 2000 are 3, 14, and 15, and the number of batch cards is 3, and they are stored in the memory portion 505 (refer to FIG. 8).

FIG. 8 is a conceptual diagram of the information on the number of batch cards and card Nos. for the tray card read by the barcode reader 70 installed in the sheet processing apparatus 110.

On the other hand, the sheet processing apparatus obtains the information stored in the server 100 via the communication line (Step S5). In the embodiment of the present invention, it obtains the information corresponding to FIG. 7.

And, the CPU 504 checks the information obtained from the server 100 with the information read at Step S4 (Step S6).

In this embodiment, on the basis of the information shown in FIG. 7 and the information shown in FIG. 8, before and after the preprocess and apparatus process, the CPU 504 checks for whether the number of batch cards for each tray card is correct or not or the batch card Nos. are correct for the tray card No. or not.

Concretely, in this embodiment, at the preprocess stage, the tray card No. in the first handling box B is 1000, and the batch card Nos. in the handling box B are 2, 10, 11, and 13, and the number of batch cards is 4. At the apparatus process stage, the tray card No. in the first handling box B is 1000, and the batch card Nos. in the handling box B are 2, 10, 11, and 13, and the number of batch cards is 4. As a result of checking the preprocess stage with the apparatus process stage, "consistency" is obtained.

At the preprocess stage, the tray card No. in the next handling box B is 2000, and the batch card Nos. in the handling box B are 3, 14, and 15, and the number of batch cards is 3. At the apparatus process stage, the tray card No. in the next handling box B is 2000, and the batch card Nos. in the handling box B are 3, 14, and 15, and the number of batch cards is 3. As a result of checking the preprocess stage with the apparatus process stage, "consistency" is obtained. The checking process is performed in this way.

Figure 9:
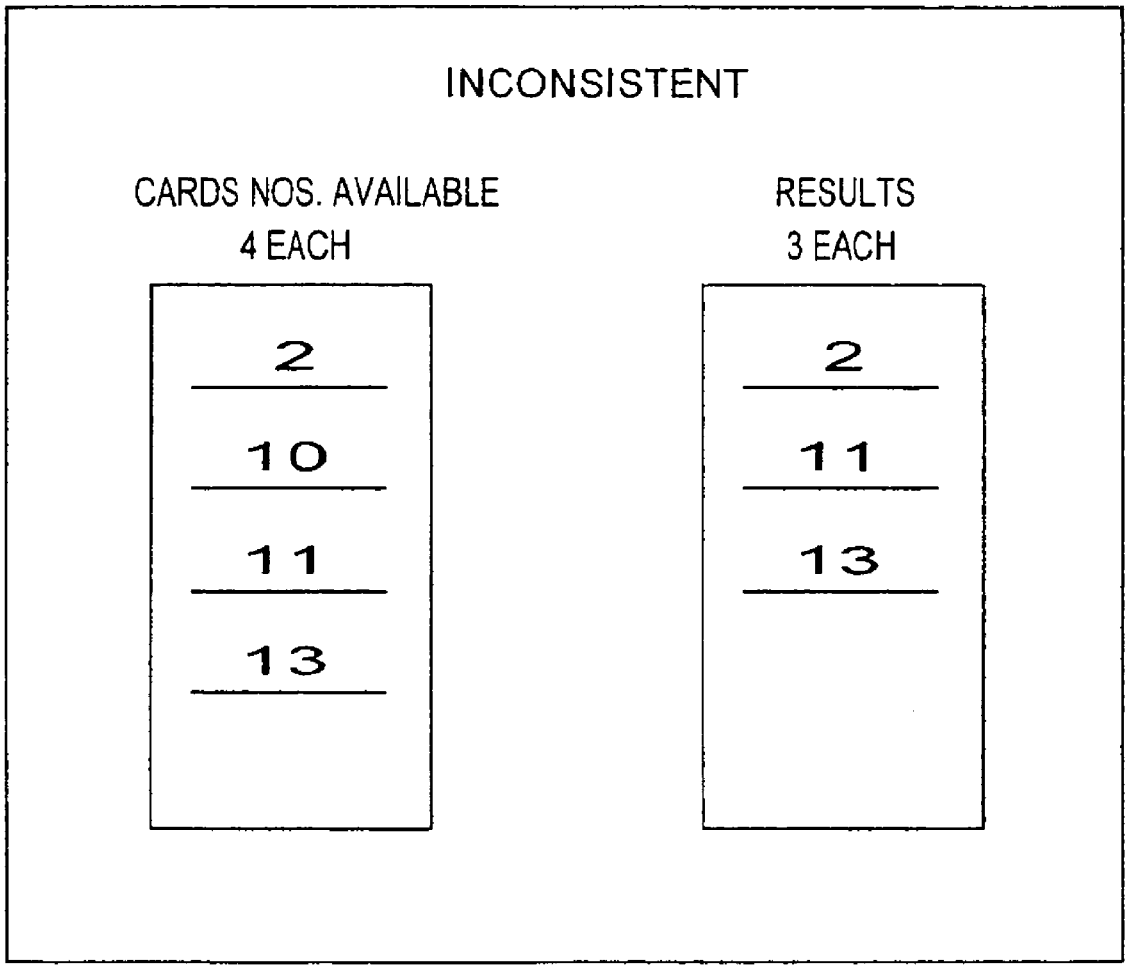
FIG. 9 is a drawing showing the check results on the operation display.

The results of the checking process are displayed on the operation display 552 of the sheet processing apparatus 110. In the above description, the case that the checking results are "consistent" with each other is explained, though when the checking results are inconsistent with each other, as shown in FIG. 9, the CPU 504 displays the purport on the operation display 552 and performs a process such as stopping the process of the sheet processing portion 1 (Step S7). Namely, as shown in FIG. 9, although the batch card Nos. should be 2, 10, 11, and 13, as a result of checking, it is found that the read batch card Nos. are 2, 11, and 13 and the batch No. 10 is missing, thus "Inconsistency" is displayed.

According to the aforementioned embodiment of the present invention, by use of a simple constitution such that for the barcodes of the batch cards and tray card, the same cards are used, and the identification code is assigned to the same part of each card, the checking operation at the preprocess stage performed by the arrangement device 120 and the apparatus process stage performed by the sheet processing apparatus 110 can be performed. Therefore, the system can prevent, for example, forgetting to count sheets of one batch in the handling box B or intentional pull-out of sheets of one batch.

Further, the present invention is not limited straight to the embodiment aforementioned but at the execution stage, within a range which is not deviated from the objects thereof, can modify and realize the components.

What is claimed is:

1. A sheet processing system for counting and sorting sheets, and including a server coupled to a communication line, the system comprising:

an arrangement device that includes:

an input unit configured to input attribute information of the sheets;

a first reading apparatus configured to: (a) sort the sheets into a first sheet group and a second sheet group based on a first identification card corresponding to the first sheet group and a second identification card corresponding to the second sheet group, (b) unify the first sheet group and the second sheet group to form one processing unit identified by a unified identification card, and (c) read first identification information, second identification information, and unified identification information assigned respectively to the first identification card, the second identification card, and the unified identification card; and a transmitting unit configured to process the input attribute information, the first identification information, second identification information, and unified identification information read by the first reading apparatus to provide processed arrangement information and transmit the processed arrangement information to the server via the communication line;

a sheet processing apparatus that includes:

a processing apparatus configured to convey and sort the first sheet group, second sheet group, the first identification card, the second identification card, and the unified identification card as indicated by the processed arrangement information provided by the arrangement device;

a second reading apparatus configured to read the first identification information, the second identification information, and the unified identification information; and a CPU configured to confirm the processed arrangement information obtained from the server via the communication line by comparing with the first identification information, the second identification information, and the unified identification information read by the second reading apparatus.

2. The sheet processing system according to claim 1, wherein the input unit is a keyboard and the attribute information input from the keyboard is a sum of money and an account number of the sheets.

3. The sheet processing system according to claim 1, wherein the first reading apparatus is a hand scanner.

4. The sheet processing system according to claim 1, wherein the second, reading apparatus is a barcode reader.

5. The sheet processing system according to claim 1, wherein the arrangement device further includes a handling box to store the one processing unit composed of the first sheet group, the first identification card, the second sheet group, the second identification card, and the unified identification card.

6. The sheet processing system according to claim 1, wherein the sheet processing apparatus further includes a supply portion configured to receive the first sheet group, the second sheet group, the first identification card, the second identification card, and the unified identification card arranged by the arrangement device.

7. The sheet processing system according to claim 1, wherein the sheet processing apparatus further includes a display unit to display the confirmation results of the CPU.

8. A sheet counting and sorting method for a sheet processing system that includes an arrangement device, a sheet processing apparatus, and a server coupled to a communication line, the method comprising:

inputting, via the arrangement device, attribute information of the sheets;

sorting, via a first reading apparatus of the arrangement device, the sheets into a first sheet group and a second sheet group based on a first identification card corresponding to the first sheet group and a second identification card corresponding to the second sheet group;

unifying the first sheet group and the second sheet group to form one processing unit identified by a unified identification card;

reading first identification information, second identification information, and unified identification information assigned respectively to the first identification card, the second identification card, and the unified identification card;

processing the input attribute information and the first identification information, second identification information, and unified identification information read to provide processed arrangement information;

transmitting the processed arrangement processing information to the server via the communication line;

conveying and sorting, by the sheet processing apparatus, the first sheet group and second sheet group, the first identification card, the second identification card, and the unified identification card as indicated by the arrangement information provided by the arrangement device;

reading, via a second reading apparatus of the sheet processing apparatus, the first identification card, the second identification card, and the unified identification card; and confirming the processed arrangement information obtained from the server via the communication line by comparing with the first identification information, the second identification information, and the unified identification information read by the second reading apparatus.

9. The method according to claim 8, wherein the sheet attribute information is input from a keyboard and the input attribute information is a sum of money and an account number of the sheets.

10. The method according to claim 8, wherein in the arrangement device, the first identification information, the second identification information, and the unified identification information are read by a hand scanner.

11. The method according to claim 8, wherein in the sheet processing apparatus, the first identification information, the second identification information, and the unified identification information are read by a barcode reader.

12. The method according to claim 8, wherein the arrangement device further storing the one processing unit composed of the first sheet group, the first identification card, the second sheet group, the second identification card, and the unified identification card in a handling box.

13. The method according to claim 8, wherein the sheet processing apparatus further receiving the first sheet group, the second sheet group, the first identification card, the second identification card, and the unified identification card arranged by the arrangement device in a supply portion.

14. The method according to claim 8, wherein the sheet processing apparatus further displaying the confirmation results on a display unit.

* * * * *